US006598577B1

(12) United States Patent
Marino

(10) Patent No.: US 6,598,577 B1
(45) Date of Patent: Jul. 29, 2003

(54) INTAKE VALVE

(76) Inventor: Vincent R. Marino, 22002 Ybarra Rd., Woodland Hills, CA (US) 91364

( * ) Notice: Subject to any disclaimer, the term of this patent is extended or adjusted under 35 U.S.C. 154(b) by 0 days.

(21) Appl. No.: 10/308,273

(22) Filed: Dec. 4, 2002

(51) Int. Cl.[7] ..... F02N 3/00
(52) U.S. Cl. ..... 123/188.3; 123/79 C
(58) Field of Search ..... 123/188.2, 188.3, 123/79 C

(56) References Cited

PUBLICATIONS

A rticle: (A uthor Unknow n), "Variable Valve System", A merican Iron (Sep. 2000), p. 135.

*Primary Examiner*—Noah P. Kamen

(74) *Attorney, Agent, or Firm*—Elliott N. Kramsky

(57) ABSTRACT

An intake valve includes a floating seat for attaining variable valve timing. A valve stem is integral with a valve head base. The valve head base includes a region for accommodating a peripheral ring in vertically-actuable relationship. The region of the valve head base for accommodating the peripheral ring includes a vertical locking portion and an upwardly-convex portion that mates with an downwardly-concave portion of the interior of the peripheral ring. A port may be arranged to vent gases at an upwardly-sloping portion of the bottom of the interior of the peripheral ring, thereby preventing instantaneous gas seepage while the peripheral ring is elevated. The vertical locking arrangement is positioned at the inner circumference of the peripheral ring to permit adjustment of peripheral ring travel without adding to the mass of the valve head.

18 Claims, 3 Drawing Sheets

FIG. 1 PRIOR-ART
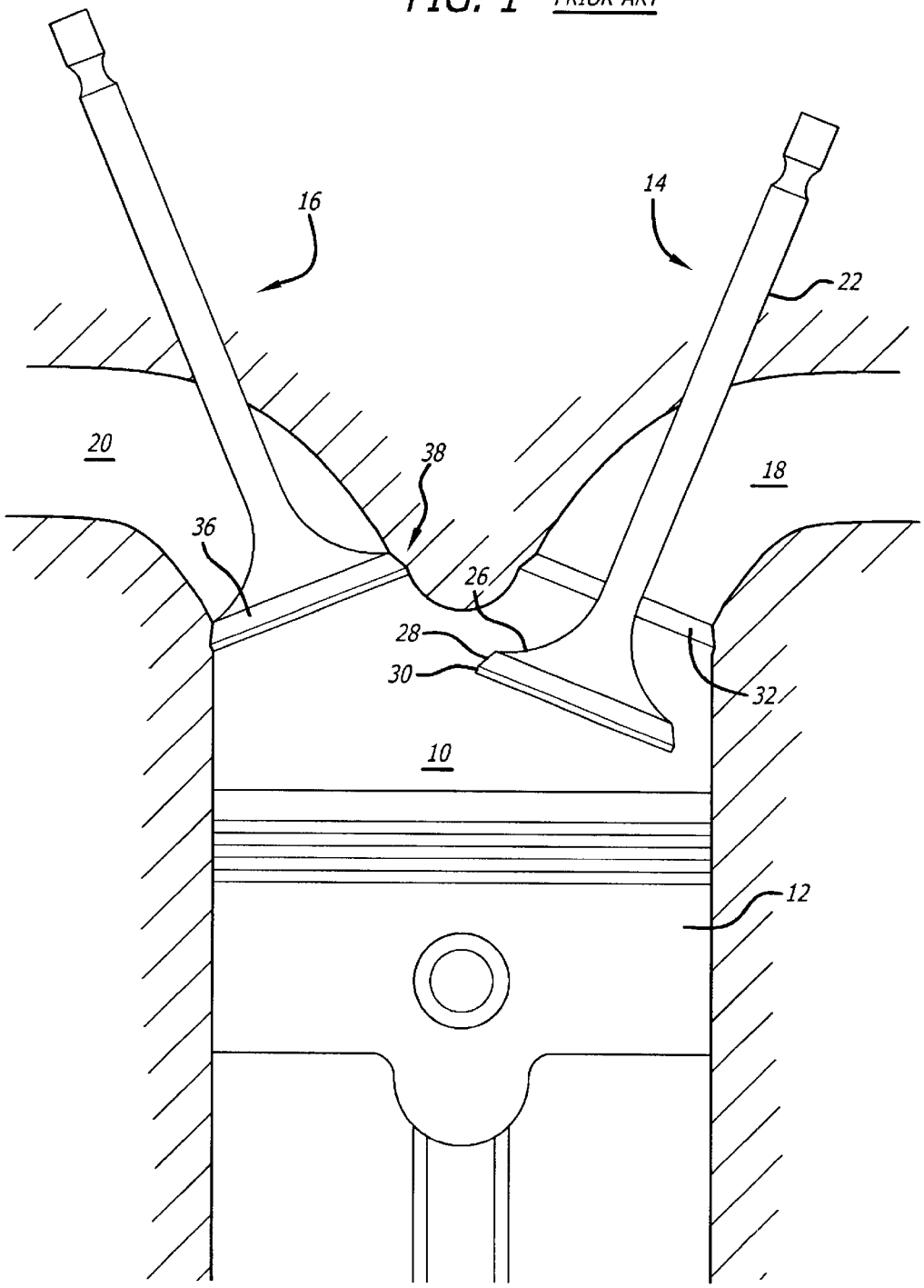

INTAKE VALVE

BACKGROUND

1. Field of the Invention

The present invention relates to intake valves for internal combustion engines. More particularly, this invention pertains to an intake valve that includes a floating valve seat.

2. Description of the Prior Art

Among the most critical elements of an internal combustion engine are the valves that regulate the gas flow into and out of the combustion chambers. Each chamber houses a reciprocating piston. Thus, for example, an eight cylinder engine has eight pistons requiring the careful regulation of sixteen valves (assuming two valves per cylinder).

The output of the engine consists of rotation of a crankshaft. This is distributed to the wheels by means of a differential engaged to an axle. Rotation of the crankshaft is produced through successive, phased inputs of angular motion via connecting rods pivotally engaged at one end to pistons, and, at the other, to rod journals which are often offset from the main journals that lie along the axis of rotation of the crankshaft. The application of successive, phased forces to the offset journals results in crankshaft rotation.

The axis of rotation of the crankshaft is aligned with that of a drive shaft that can be engaged and disengaged from the crankshaft by means of a clutch. The output of the drive shaft is, in turn, employed, to drive the wheels of the vehicle through the differential.

Thus, an internal combustion engine translates the reciprocating motions of the pistons into rotation of a shaft. The generation of the reciprocating movements of the pistons is accomplished through the well-understood four-stroke process of internal combustion known as the Otto cycle. The four elements of this process include an "intake stroke" during which a mixture of air and fuel is received at the top of the combustion chamber (i.e. above the piston) from a carburetor or fuel injectors. The piston travels downwardly (pulled by the rotating crankshaft via the connecting rod), creating a vacuum that sucks in the air-fuel mixture. After the intake stroke, the portion of the combustion chamber above the piston is sealed by the closure of an intake valve and a "compression stroke" is commenced during which the connecting rod pushes the piston upwardly, compressing the air-fuel mixture. Once the compression stroke has been completed, a high-voltage spark is emitted by a spark plug, igniting the air-fuel mixture within the sealed combustion chamber. The resulting combustion of the mixture causes an expansion of gaseous volume, generating a force that acts downwardly upon the top of the piston during a "power stroke". This drives the piston down to impart rotation to the crankshaft. The amount of angular motion imparted is, in part, dependent upon the number of engine cylinders. Once this motion has been completed, the gases within the combustion chamber are vented during an "-exhaust stroke" as the piston is again driven upwardly within the cylinder by the rotation of the crankshaft and the exhaust valve that regulates the passage of gases through an exhaust port is opened. Another four-stroke cycle then begins with another intake stroke in which air-fuel mixture is admitted through a reopened intake valve and the exhaust valve is closed. At a typical freeway engine speed of 2200 r.p.m., the entire four-stroke process is completed at a rate of eighteen times per second in each cylinder.

Intake and exhaust ports communicate with the portion of the cylinder that lies above top dead center of the piston (i.e., the combustion chamber). The intake and exhaust valves seal the head ports. The motions of the valves are derived from the crankshaft of the engine through a valve train linkage that includes the valve itself.

The valves include elongated stems and terminate in generally-circular broadened heads that include angled faces cut to match an angle formed by a head seat formed within the engine head. The head seats and poppet-type valves interact whereby the combustion chamber is opened to communicate with the intake and/or exhaust ports by the action of the valve train pushing down on the valves and then closed by a spring, a side component of the valve train. The spring returns the valve (stem protruding from the combustion chamber of the head to the rocker assembly side of the head) until its enlarged head abuts the head seat adjacent the top of the combustion chamber. A seal is formed between the circumferential face of the valve and the circular head seat. Conversely, an intake valve admits a gaseous mixture when driven downwardly to disengage the valve face from the head seat located in the combustion chamber of the engine head.

The cam of the valve linkage that defines the relationship between rotation of the crankshaft (and, thus travel of the piston within the cylinder) and the opening and closing of the intake and exhaust valves is of static design. Since the cam possesses a static, fixed shape, the relative timing of the opening and closing of the valves with respect to the travel of the piston within its cylinder is correspondingly limited or static.

The mass, and resulting momentum and inertia, of the valve train constrains the ability of the engine to operate in an idealized manner insofar as the coordination of valve operation and piston movements within the combustion chamber. For example, a typical profile of the intake stroke might consist of the cam gear gradually opening the inlet valve by one-eighth inch upon the piston having.traveled downwardly by two inches, then increasing to one quarter inch when piston travel has increased to three inches, then continuing to be held open by one-quarter inch during the fourth inch of travel of the piston. The valve might then begin to close during the interval between the fourth and fifth or final inches of downward travel of the piston. This would occur in anticipation of its imminent closure for the subsequent compression stroke.

Such "preparation" of the valve for closure during the transition from the intake to the compression stroke, built into the shape of the cam, is an acknowledgment of the inability of the valve train to reverse direction instantaneously in view of its mass. The non-idealized operation of the valve with respect to the movement of the piston within the combustion chamber has the effect of either forcing some amount of the fresh air-fuel mixture out of the chamber through the intake port (in the event that the point of closure of the intake valve occurs after the direction of the piston has reversed) or the admission of a less-than-maximum amount of air-fuel mixture into the chamber (in the event that the point of closure occurs somewhat prior to completion of downward travel of the piston). In either event, the torque generated by the engine is reduced below that theoretically possible with a valve linkage of zero mass.

An additional practical limitation upon valve operation is crankshaft rotation rate (in r.p.m.). Practical cam design requires more gradual transitions between valve openings and closings at a high r.p.m. engine output to prevent risk of valve train element disengagements. The resultant gradual reversals of valve direction further reduce the torque that may be generated by an internal combustion engine through reduction and/or contamination of intake of fresh air-fuel mixture and loss of compression.

Like issues pertain to the transition from the exhaust to the intake strokes. The exhaust valve, symmetrically located at the top of the combustion chamber with respect to the intake valve, undergoes closure during this transition. In the event that the intake valve, making a transition from a closed to an open attitude as the piston rises to the top of its travel, opens "early" (before the exhaust valve has closed and the piston reached the top of the chamber, a condition known as "overlap"), exhaust gases can escape from the chamber through the slightly open intake valve and into the intake port (a condition known as "reversion"). This will contaminate the fresh air-fuel mixture admitted during the intake stroke. Conversely, should the intake valve open "late" (after the exhaust valve has closed and the piston has already begun downward travel), less than the theoretically-possible maximum amount of air-fuel mixture will enter the cylinder during the intake stroke. In either case, the torque generated during the following power stroke is ultimately reduced.

One approach to the above-described problems of static valve timing is a device marketed under the trademark SMART VALVE by Acro-Tech, Inc. which is described in "Variable Valve Timing", *American Iron Magazine* (September 2000) at page 135. Such device comprises an intake valve, suitable for retrofitting to a four cycle engine, that is characterized by a two-part valve head structure. Such structure consists of a valve head base and a surrounding peripheral ring. The valve head base comprises an otherwise-conventional valve head machined to accommodate the peripheral ring in slidable, locking relationship. The precise vertical position of the peripheral ring is responsive to gas pressure within the combustion chamber. When actuated by gas pressure to travel upwardly either at the beginning of the compression stroke or at the transition from exhaust stroke to intake stroke, the peripheral ring, in combination with the valve head base, seals the intake port prior to the time otherwise dictated by the fixed shape of the cam. This results in a type of variable valve timing in which loss or contamination of air-fuel mixture and/or compression loss is minimized and engine torque is thereby increased.

While offering a useful concept, the precise design of the device described above is subject to a number of weaknesses. The design permits a continuous escape of gases through actuation port holes when the ring is in the lifted position due to the location of the lock mechanism. In addition, the location of the locking mechanism for slidably securing the peripheral ring to the valve head base (in the region of the margin of the valve head), limits the ability of a designer to increase the vertical travel of the peripheral ring without increasing the mass of the valve head and ring. Finally, the positioning of the locking mechanism subjects potential areas of weakness to maximum stressing and permits the cocking of the peripheral ring with respect to the axis of the valve, permitting the peripheral ring's locking lip to drag against the valve head margin area, increasing wear. The mating areas will allow excessive use to hammer the peripheral ring below its desired seating position. The design also incorporates knife edges on the ring that are susceptible to abuse.

SUMMARY OF THE INVENTION

The invention addresses the preceding and other shortcomings of the prior art by providing, in a first aspect, an intake valve for an internal combustion engine. The valve includes an elongated valve stem having opposed ends. A valve head base is located at one end of and integral with the valve stem. A peripheral ring is provided.

The valve head base includes a region adapted to receive the peripheral ring in vertically-actuable relationship. The peripheral ring includes an inner vertical portion and an outer, inclined valve seat. The region of the valve head base for receiving the peripheral ring includes an inner vertical portion in opposed relationship to the inner vertical portion of the peripheral ring.

The inner vertical portion of the peripheral ring has an inwardly-directed annular flange and the inner vertical portion of the region of the valve head base has an outwardly-directed annular flange for slidably locking the peripheral ring to the valve head base.

In a second aspect, the invention provides an internal combustion engine that includes an intake valve in accordance with the embodiment described above.

In a third aspect, the invention provides an intake valve for an internal combustion engine. The valve includes an elongated valve stem having opposed ends. A valve head base is located at one end of and integral with the valve stem. A peripheral ring is provided.

The valve head base includes a region adapted to receive the peripheral ring in vertically-actuable relationship. The peripheral ring includes an inner vertical portion and an outer, inclined valve seat. The region of the valve head base includes an upwardly-convex surface.

The peripheral ring includes a downwardly-concave base surface. The upwardly-convex and downwardly-concave surfaces are arranged to mate when the peripheral ring is in a non-actuated state.

The preceding and other features of this invention will become further apparent from the detailed description that follows. Such description is accompanied by a set of drawing figures. Numerals of the drawing figures, corresponding to those of the written description, point out the features of the invention with like numerals referring to like features throughout both the written description and the drawing figures.

BRIEF DESCRIPTION OF THE DRAWINGS

FIG. 1 is an idealized partial side-sectional view in elevation of the upper portion (above the piston) of a combustion chamber of an internal combustion engine in accordance with the prior art;

DETAILED DESCRIPTION OF THE PREFERRED EMBODIMENT

Figure 2A:
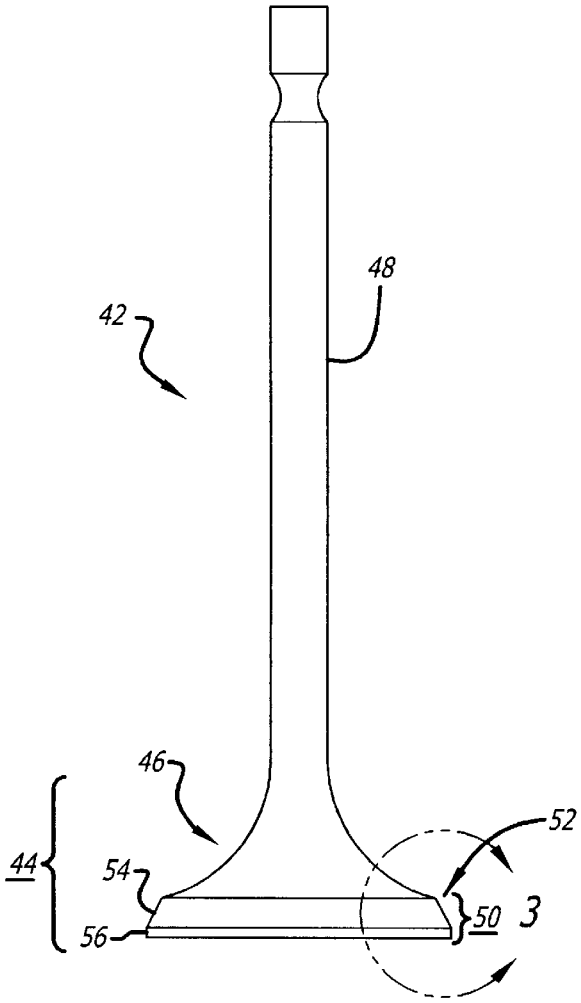
FIGS. 2(*a*) and 2(*b*) are side elevation views of an intake valve of the floating valve seat type in accordance with the prior art for illustrating the principle of variable valve timing.

FIG. 1 is an idealized partial sectional view in elevation of the upper portion 10 (above the piston 12) of a combustion chamber of an internal combustion engine in accordance with the prior art. The chamber includes conventional intake 14 and exhaust valves 16 of the poppet type mounted for regulating flow of gases into and out of the combustion chamber in accordance with the operational principles of the well-known four stroke Otto cycle, described above. The operation of the engine involves the coordination of gas flow through the intake and exhaust ports 18 and 20 by means of opening and closing of the intake and exhaust valves 14 and 16 respectively with the up-and-down movements of the piston 12 within the combustion chamber or cylinder.

As illustrated, the structures of the prior art intake and exhaust valves 14 and 16 are similar in overall shape. Referring to the intake valve 14, it includes an elongated stem 22 that is integral with and terminates in an enlarged head portion 26. The head portion 26 is shaped with an inclined seat 28 and a peripheral margin 30.

The inclined valve seat 28 is designed to mate with a similarly-inclined head seat 32 positioned at the transition of the intake port 18 to the combustion chamber 10. (Similarly, the exhaust valve 16 includes an inclined valve seat 36 that mates with a head seat 38 at the transition between the combustion chamber and the exhaust port 20.

FIG. 1 illustrates the intake stroke of the combustion chamber in which the intake valve 14 has been forced downwardly to disengage from the head seat 32, thereby opening the intake port 18, by the action of a valve linkage (not illustrated, discussed above) to which it is coupled while the exhaust valve 16 has been seated to close the exhaust port 20 by the action of a spring (not illustrated).

The action of the valve linkage that opens the intake valve 14 to admit air-fuel mixture for the intake stroke, is mechanically coupled to the mechanism that drives the piston 12. Upon release of downward pressure from the valve linkage, the intake valve 14 will be drawn into the closed position by the action of a valve spring (also not illustrated in FIG. 1) just as the exhaust valve 16 has been.

Figure 2B:
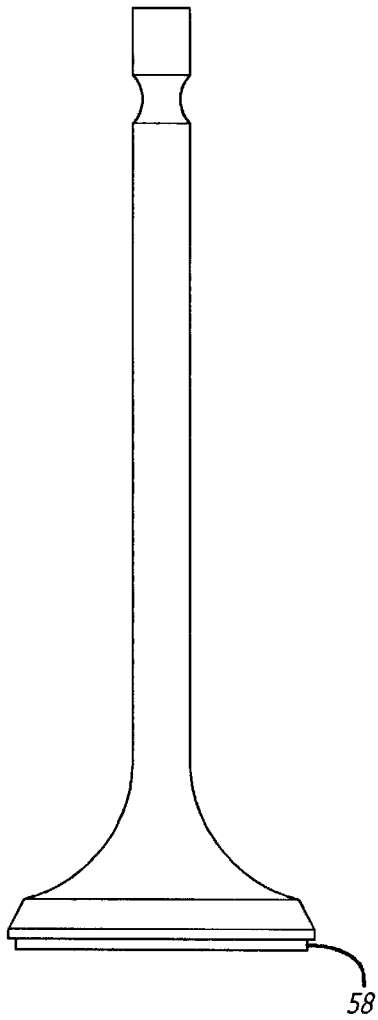

The problems relating to static valve timing deriving from a cam of fixed shape have been discussed above and are addressed to some extent by the apparatus of Acro-Tech, Inc. described in the previously-referenced article. The principle of operation of the prior art floating seat valve for achieving variable valve timing is illustrated in FIGS. 2(*a*) and 2(*b*), side elevation views of an intake valve of the floating seat type in accordance with the prior art. In contrast to the design of a conventional intake valve 14 of the poppet type as illustrated in the preceding figure, the intake valve 42 of FIGS. 2(*a*) and 2(*b*) includes a two-part valve head 44 comprising a valve head base 46 that is integral with an elongated valve stem 48 and a peripheral ring 50 that is slidably engaged to the valve head base 46. The means for slidably coupling the valve head base 46 to the peripheral ring 50 will be disclosed and discussed in detail below.

Various portions of the valve head base 46 and the peripheral ring 50 correspond generally to regions of the conventional intake valve of FIG. 1 when fully mated in the closed position shown in FIG. 2(*a*). Thus a backside 52 is formed in the valve head base 46 where the interior of the peripheral ring 50 slidably secures and mates to the valve head base 46. A valve seat 54 and an outer margin 56 are formed at the exterior of the peripheral ring 50.

Figure 3:
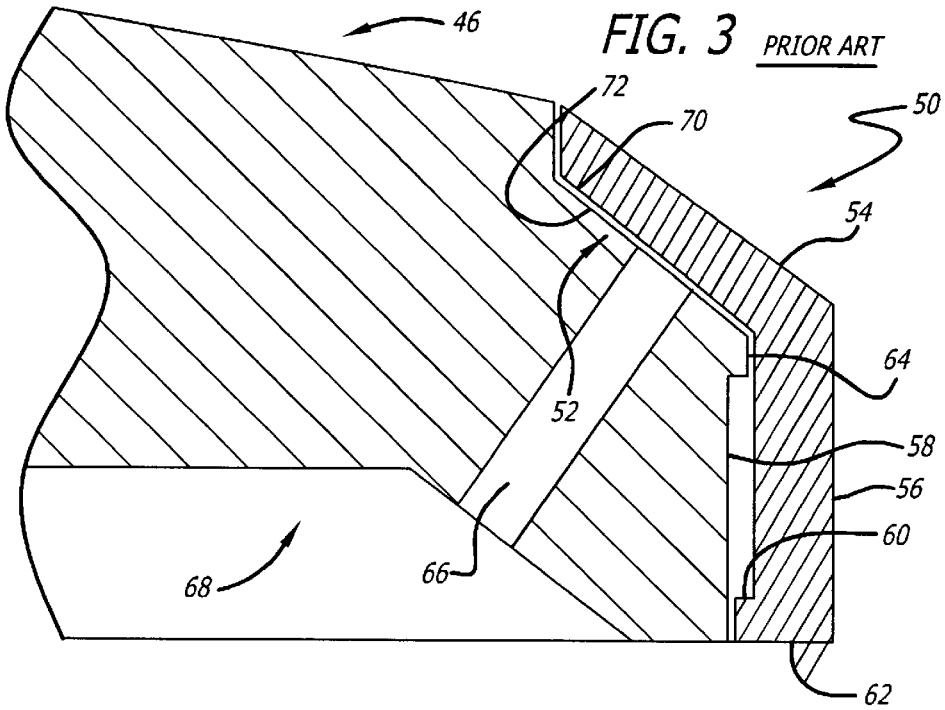
FIG. 3 PRIOR ART
FIG. 3 is a detailed partial sectional view of an intake valve taken at line 3 of FIG. 2(*a*)

An inner margin 58, exposed in FIG. 2(*b*), is formed in valve head base 46, forming the lower section of the backside 52 for mating with the interior side of the peripheral ring 50. FIG. 3 shows a full view of the backside 52 which is formed by the surfaces 72, 64 and 58.

The operation of the floating seat may be appreciated by contrasting the orientation of the peripheral ring 50 with respect to the valve head base 46 in FIG. 2(*a*) with that of FIG. 2(*b*). As can be seen, in FIG. 2(*b*) the peripheral ring is elevated from its position in FIG. 2(*a*), exposing the inner margin 58 at the lower portion of the valve head base 46. Referring back to FIG. 1 and inserting the floating seat design, it will be appreciated that the ability of the peripheral ring 50 that carries the valve seat 54 to elevate above the valve head base 46, which is integral with the valve stem 48, enables the valve 42 to seal the intake port 18 by mating the valve seat 54 with the head seat 32 prior to the "arrival" of the valve head base 46 at the head seat 32. It is this ability of the relatively-low mass peripheral ring to seal the intake port 18 prior to the time that the elements of the valve linkage (of much greater mass) are capable of, or timed to accomplish such sealing relationship that provides the variable valve timing that overcomes the delays inherent in static valve timing described above. As mentioned earlier, such momentum and inertia-mandated delays that cause, for example, the overlapping of the opening of the intake valve prior to the complete closure of the exhaust valve on the exhaust stroke (resulting in the contamination of the air-fuel mixture with some exhaust gas content). The ability of the peripheral ring 50 to seal an intake port while the intake valve 42 is lifting off its seat before the exhaust stroke has ended enables the period of overlap to be minimized and/or eliminated.

The elevated position of the peripheral ring 50 is achieved in response to the generation of gas pressure within the combustion chamber during the beginning and ending of the exhaust stroke during the period of overlap. The mechanism for slidably securing the peripheral ring 50 to the valve head base 46 so that the peripheral-ring 50 will react to gas pressure within the combustion chamber will become apparent from FIG. 3, a detailed partial sectional view of an intake valve with variable valve timing in accordance with the prior art taken at line 3 of FIG. 2(*a*).

As can be seen in FIG. 3, the peripheral ring 50 is slidably secured to the valve head base 46 by means of a locking mechanism. The locking mechanism comprises an annular flange 60 that protrudes inwardly from the lower edge 62 of the peripheral ring 50 and an annular flange 64 that protrudes outwardly from a region of the valve head base 46 that is adapted to receive the peripheral ring 50.

A port 66 (one of an array that is preferably symmetrically located about the bottom 68 of the valve head base 46) is provided for venting gases under high pressure from within the combustion chamber during the compression and exhaust strokes to thereby lift the peripheral ring 50 to the position or attitude illustrated in FIG. 2(*b*) whereby the valve seat 54 is elevated to be seated against the head seat 32 to close the intake port 18 prior to the time that the valve linkage, including a cam of fixed shape, is capable, due to the above-described limitations of fixed valve timing, of lifting the portion of the intake valve that is integral with the valve stem 48 to seal this port. The rapid sealing of the intake port 18 provides additional flexibility in the design of the intake valve linkage, the exhaust valve timing and the coordination of the travel of the piston 12 within the combustion chamber with the valve timing. As a result, horsepower is increased (as air-fuel mixture can be admitted during a greater portion of the intake stroke and will suffer less contamination due to the decrease or elimination of overlap) and greater r.p.m. is possible for a given output due to lowered stressing of the valve linkage.

While the prior art intake valve with a floating valve seat 54 machined onto a peripheral ring 50 offers significant advantages of variable valve timing over the conventional integral intake valve, the prior art design is subject to a number of weaknesses. These result, in large measure from the greater complexity of a two-part structure that must operate with great precision both repetitively and at high speeds within a very hostile environment. For example, the upward thrust of high pressure gases through the port 66 allows some seepage of exhaust gases or intake charge upward and into the intake port 18 during the time the peripheral ring 50 is in its lifted position to seal the port 18. Such seepage occurs within a flow path momentarily existing between the upper inner surface 70 of the peripheral ring 50 and the outer surface 72 of the region of the valve head base 46 for accommodating the peripheral ring 50.

Additionally, the design of the prior art valve of FIG. 3 offers limited flexibility with regard to the possible length of vertical travel of the peripheral ring 50. Such vertical travel is defined and limited by the vertical distance between the inwardly-directed flange 60 and the outwardly-directed flange 64. To increase this length, both the outer margin 56 and the corresponding thickness of the broadest area of the valve head base 46, the inner margin 58, must be lengthened. This may result in significantly increasing the mass of the intake valve and the peripheral ring. As a result, the valve train becomes more difficult to control as well as the clearances between intake and exhaust valves or intake valve and piston. In addition, increased valve mass limits engine r.p.m. and reduces engine life. Finally, the prior art design of FIG. 3 allows flexion of the outer margin 56 whereby the locking mechanism 60 of the ring 50 can drag against the inner margin 58 of the valve head base. Such cocking of the peripheral ring 50 may lead to the rapid loss of effective functioning of the ring 50 and negate the advantages that follow from variable valve timing.

Figure 4:
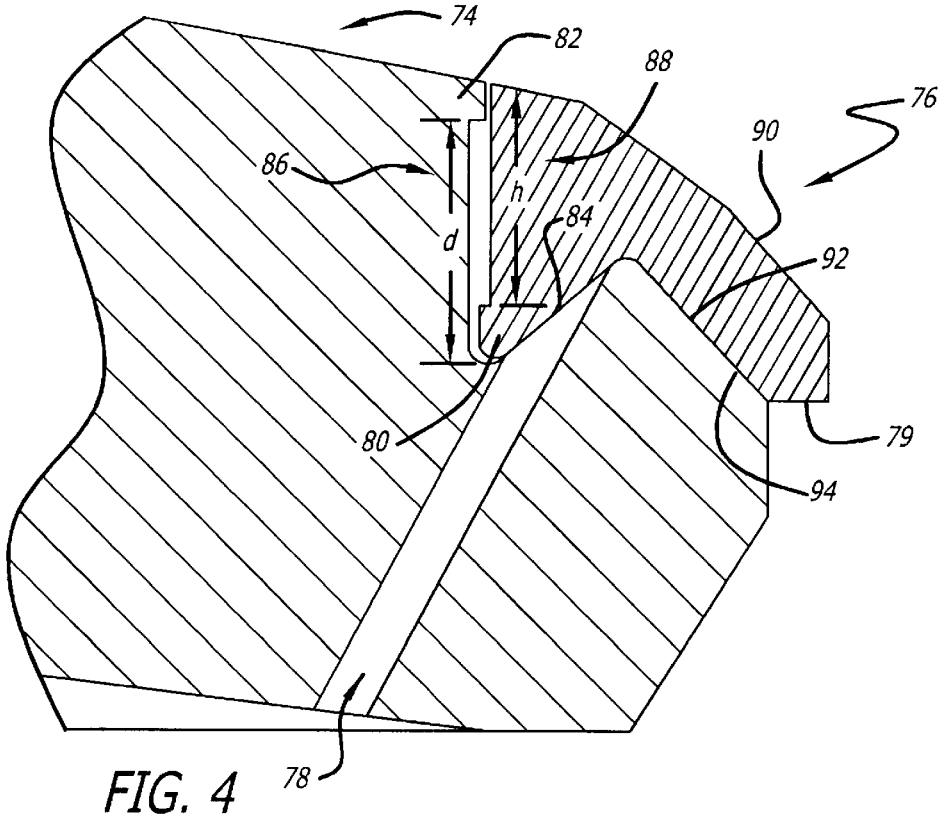
FIG. 4 is a detailed partial sectional view of an intake valve in accordance with the invention corresponding to the view of the prior art valve of the previous figure.

FIG. 4 is a detailed partial sectional view, corresponding to the preceding view of the prior art valve, of an intake valve in accordance with the invention. The valve of FIG. 4 operates generally in accordance with the principles of operation of the valve of FIGS. 2(*a*), 2(*b*) and 3. However, it offers a number of design features that address shortcomings of an intake valve with a floating valve seat in accordance with the prior art.

As in the case of the above-described intake valve with floating valve seat, the intake valve of the invention relies upon the principle of a cooperative valve head base 74 and peripheral ring 76. The peripheral ring 76 is arranged within a region of the valve head base 74 to be vertically slidable with respect to the base 74 in response to pressure within the combustion chamber upon initiation of the compression stroke and completion of the exhaust stroke to provide the advantages of variable valve timing. As before, ports, such as the port 78 are arranged about the bottom of the valve head base 74 to admit the pressurized gases that thrust the peripheral ring 76 upwardly to sealing relationship with a valve head seat to seal the intake port in a way that cannot be achieved by static valve timing as discussed with reference to FIG. 1. As an aside, it is both theoretically and actually possible to design a valve with floating valve seat without employing the ports 66 and 78 of the device of the prior and present figures. In such cases, actuation of the peripheral rings 50 and 76 will be dependent upon the force of pressurized gases against the annular lower edges 62, 79 of the peripheral rings 50 and 76 respectively.

The peripheral ring 76 of the intake valve of the invention differs significantly from that of the prior figure. The ring 76 is slidably locked to the valve head base by the interaction of an inwardly-directed annular flange 80 of the ring 76 with and outwardly-directed flange 82 of the valve head base 74. However, in contrast to the prior art device, such locking mechanism neither coincides with nor parallels the margins 56 and 58 of the intake valve. That is, it is not located at the outer periphery of the valve head base 74. As a result, it is possible to lengthen the travel of the peripheral ring 76 without increasing the mass of the valve or elongating the margin. The depth "d" of the region of the valve head base 74 for receiving the ring 76 might be increased (along with a corresponding increase in the length."h" of the peripheral ring 76). By providing this capability, the design of the valve timing can be varied without incurring the complications that arise when the mass of the valve is increased.

In addition, the positioning of the locking mechanism assures a positive seal preventing the escape of gases through the port holes 78 into an intake port when the ring 76 is in the lifted position. That is, both the inwardly-directed annular flange 80 and the outwardly-directed flange 82, which comprise the locking mechanism of the valve of the invention, project into the path of pressurized gases escaping from the combustion chamber to lift the peripheral ring 76. This blocks the possible leakage of such gases into the intake port once the peripheral ring 76 has sealed the port. In contrast, the locking mechanism of the device of FIG. 3 lies below the upper end of the port 66, leaving no like structures to project into the leakage path for escaping pressurized gases once the peripheral ring 50 has been lifted to seal an intake port. By eliminating the possibility of such leakage, the intake valve of the invention permits an internal combustion engine to attain greater torque and horsepower than one equipped with intake-valves with a floating valve seat in accordance with the prior art.

The valve seat 90 of an intake valve in accordance with the invention is opposed by the upwardly-sloped portion 92 of the downwardly-concave bottom surface of the peripheral ring 76. This assures that the substantial force of impact between the seated peripheral ring 76 and the upwardly-sloped portion 94 of the upwardly-convex upper surface of the region of the valve head base 74 for receiving the peripheral ring 76 upon contact does not occur at a stress point of the design. This is to be contrasted with the prior art design of the preceding figures in which a vertical margin 56 is joined to the valve seat 54 in a region adjacent the outwardly-directed annular flange 64 of the valve head base 46. Such a combination risks the imposition of substantial force with each valve closure, limiting valve and seat life through cocking or breakage of the peripheral ring 50. The mating surfaces of the peripheral ring 76 and the valve head body 74, discussed above, assure that the peripheral ring 76 will always return to an uncocked attitude and a proper seated height as illustrated in FIG. 4.

The invention allows further weight reductions and various valve head shapes to be employed for clearance and gas flow designs in the area otherwise occupied by the inner and outer margins 58 and 56 in FIG. 3.

Thus it is seen that the present invention provides an intake valve of the floating valve seat type that provides the advantages of variable valve timing. By employing intake valves in accordance with the invention in an internal combustion engine, one can realize the improved performance offered with variable valve timing without loss of horsepower due to instantaneous seepage of gases, without substantial limitations upon peripheral ring travel and attendant engine design and without the degradation of life and engine performance that follow unintended cocking of the peripheral ring relative to the valve head base.

While this invention has been disclosed with reference to its presently-preferred embodiment, it is not limited thereto, Rather this invention is limited only insofar as it is defined by the following set of patent claims and includes within its scope all equivalents thereof.

What is claimed is:

1. An intake valve for an internal combustion engine comprising, in combination:

a) an elongated valve stem having opposed ends;

b) a valve head base located at one end of and integral with said valve stem;

c) a peripheral ring;

d) said valve head base including a region adapted to receive said peripheral ring in vertically-actuable relationship;

e) said peripheral ring including an inner vertical portion and an outer, inclined valve seat;

f) said region of said valve head base for receiving said peripheral ring having an inner vertical portion in opposed relationship to said inner vertical portion of said peripheral ring; and g) said inner vertical portion of said peripheral ring having an inwardly-directed annular flange and said inner vertical portion of said region of said valve head base having an outwardly-directed annular flange for slidably locking said peripheral ring to said valve head base.

2. An intake valve as defined in claim 1 further including:

a) said region of said valve head base including an upwardly-convex surface; and b) said peripheral ring including an downwardly-concave base surface; and c) said upwardly-convex and downwardly-concave surfaces being arranged to mate when said peripheral ring is in a-non-actuated state.

3. An intake valve as defined in claim 2 wherein said valve seat is in opposed relation to a downwardly-sloping portion of said downwardly-concave bottom surface of said peripheral ring.

4. An intake valve as defined in claim 1 further including:

a) at least one port through said valve head base; and b) said port terminating within the region of said valve head base exterior to said interior vertical portions of said valve head base and said peripheral ring.

5. An intake valve as defined in claim 4 wherein said port terminates at an upwardly-inclined portion of said upwardly-convex surface of said region of said valve head base for accepting said peripheral ring.

6. An internal combustion engine comprising, in combination:

a) a plurality of combustion chambers, each of said combustion chambers including an associated intake port and exhaust port;

b) each of said combustion chambers including a piston constrained to up and down movements within said chamber;

c) means for coupling the up-and-down movement of a piston within a combustion chamber to that of a piston within the adjacent combustion chamber;

d) a valve linkage coupled to said means, said valve linkage being arranged to control the passage of gases through said intake and exhaust ports;

e) said valve linkage including an intake valve for regulating the flow of gases between said intake port and combustion chamber and an exhaust valve for regulating the passage of gases between said exhaust port and said combustion chamber;

f) said intake valve including (i) an elongated, valve stem having opposed ends; (ii) a valve head base located at one end of and integral with said valve stem; (iii) a peripheral ring; (iv) said valve head base, including a region adapted to receive said peripheral ring in vertically-actuable relationship; (v) said peripheral ring including an inner vertical portion and an outer, inclined valve seat; (vi) said region of said valve head base for receiving said peripheral ring having an inner vertical portion in opposed relationship to said inner vertical portion of said peripheral ring; and (vii) said inner vertical portion of said peripheral ring having an inwardly-directed annular flange and said inner vertical portion of said region of said valve head base having an outwardly-directed annular flange for slidably locking said peripheral ring to said valve head base.

7. An internal combustion engine as defined in claim 6 wherein said intake valve further includes:

a) said region of said valve head base including an upwardly-convex surface;

b) said peripheral ring including an downwardly-concave bottom surface; and c) said upwardly-convex and downwardly-concave surfaces being arranged to mate when said peripheral ring is in a non-actuated state.

8. An internal combustion engine as defined in claim 7 wherein said valve seat is in opposed relation to a downwardly-sloping portion of said downwardly-concave bottom surface of said peripheral ring.

9. An internal combustion engine as defined in claim 6 further including:

a) at least one port through said valve head base; and b) said port terminating within the region of said valve head base exterior to said interior vertical portions of said valve head base and said peripheral ring.

10. An internal combustion engine as defined in claim 9 wherein said intake valve is further characterized in that said port terminates at an upwardly-inclined portion of said upwardly-convex surface of said region of said valve head base for accepting said peripheral ring.

11. An intake valve for an internal combustion engine comprising, in combination:

a) an elongated valve stem having opposed ends;

b) a valve head base located at one end of and integral with said valve stem;

c) a peripheral ring;

d) said valve head base including a region adapted to receive said peripheral ring in vertically-actuable relationship;

e) said peripheral ring including an inner vertical portion and an outer, inclined valve seat;

f) said region of said valve head base including an upwardly-convex surface;

g) said peripheral ring including an downwardly-concave base surface; and h) said upwardly-convex and downwardly-concave surfaces being arranged to mate when said peripheral ring is in a non-actuated state.

12. An intake valve as defined in claim 11 further including:

a) said region of said valve head base for receiving said peripheral ring having an inner vertical portion in opposed relationship to said inner vertical portion of said peripheral ring;

b) said inner vertical portion of said peripheral ring having an inwardly-directed annular flange and said inner vertical portion of said region of said valve head base having an outwardly-directed annular flange for slidably locking said peripheral ring to said valve head base;

c) at least one port through said valve head base; and d) said port terminating within the region of said valve head base exterior to said interior vertical portions of said valve head base and said peripheral ring.

13. An intake valve as defined in claim 12 wherein said port terminates at an upwardly-inclined portion of said upwardly-convex surface of said region of said valve head base for accepting said peripheral ring.

14. An intake valve as defined in claim 11 wherein said valve seat is in opposed relation to a downwardly-sloping portion of said downwardly-concave bottom surface of said peripheral ring.

15. An internal combustion engine comprising, in combination:

a) a plurality of combustion chambers, each of said combustion chambers including an associated intake port and exhaust port;

b) each of said combustion chambers including a piston constrained to up and down movements within said chamber;

c) means for coupling the up-and-down movement of a piston within a combustion chamber to that of a piston within the adjacent combustion chamber;

d) a valve linkage coupled to said means, said valve linkage being arranged to control the passage of gases through said intake and exhaust ports;

e) said valve linkage including an intake valve for regulating the flow of gases between said intake port and combustion chamber and an exhaust valve for regulating the passage of gases between said combustion chamber and said exhaust port;

f) said intake valve including (i) an elongated valve stem having opposed ends; (ii) a valve head base located at one end of and integral with said valve stem; (iii) a peripheral ring;. (iv) said valve head base including a region adapted to receive said peripheral ring in vertically-actuable relationship; (v) said peripheral ring including an inner vertical portion and an outer, inclined valve seat; (vi) said region of said valve head base including an upwardly-convex surface; (vii) said peripheral ring including an downwardly-concave base surface; and (viii) said upwardly-convex and downwardly-concave surfaces being arranged to mate when said peripheral ring is in a non-actuated state.

16. An internal combustion engine as defined in claim 15 wherein said intake valve further includes a) said region of said valve head base for receiving said peripheral ring having an inner vertical portion in opposed relationship to said inner vertical portion of said peripheral ring;

b) said inner vertical portion of said peripheral ring having an inwardly-directed annular flange and said inner vertical portion of said region of said valve head base having an outwardly-directed annular flange for slidably locking said peripheral ring to said valve head base;

c) at least one port through said valve head base; and d) said port terminating within the region of said valve head base exterior to said interior vertical portions of said valve head base and said peripheral ring.

17. An internal combustion engine as defined in claim 16 wherein said port terminates at an upwardly-inclined portion of said upwardly-convex surface of said region of said valve head base for accepting said peripheral ring.

18. An internal combustion engine as defined in claim 17 wherein said valve seat of said intake valve is in opposed relation to a downwardly-sloping portion of said downwardly-concave bottom surface-of said peripheral ring.

* * * * *